US006425739B1

(12) United States Patent
Ambler

(10) Patent No.: US 6,425,739 B1
(45) Date of Patent: Jul. 30, 2002

(54) IN-LINE CENTRIFUGAL FAN

(75) Inventor: Lindsay Ambler, Sarasota, FL (US)

(73) Assignee: R. B. Kanalflakt, Inc., Sarasota, FL (US)

( * ) Notice: Subject to any disclaimer, the term of this patent is extended or adjusted under 35 U.S.C. 154(b) by 0 days.

(21) Appl. No.: 09/535,863

(22) Filed: Mar. 27, 2000

(51) Int. Cl.[7] ..... F04D 29/44

(52) U.S. Cl. ..... 415/208.3; 415/210.1; 415/186; 415/208.1

(58) Field of Search ..... 415/208.1, 208.2, 415/210.1, 185, 186

(56) References Cited

U.S. PATENT DOCUMENTS 594,206 A * 11/1897 Jeffreys ..... 415/208.3
4,798,518 A * 1/1989 Holzberger et al. ..... 415/208.3
5,619,612 A * 4/1997 Glucksman et al. ..... 392/360

FOREIGN PATENT DOCUMENTS

GB 579770 * 8/1946 ..... 415/208.3

* cited by examiner

*Primary Examiner*—Edward K. Look
*Assistant Examiner*—Richard Woo
(74) *Attorney, Agent, or Firm*—Charles J. Prescott

(57) ABSTRACT

An in-line centrifugal fan including a housing having an inlet and an outlet spaced apart and substantially coaxial one to another and a motorized centrifugal-type impeller mounted centrally within the housing substantially coaxially between the inlet and the outlet. A plurality of spaced air flow redirecting vanes are each connected to and radially extend inwardly from the housing toward, but not to, a radially outermost perimeter of the impeller whereby air flow through the housing is increased by the vanes. Various vane configurations, clearances and number of vanes are disclosed.

3 Claims, 11 Drawing Sheets

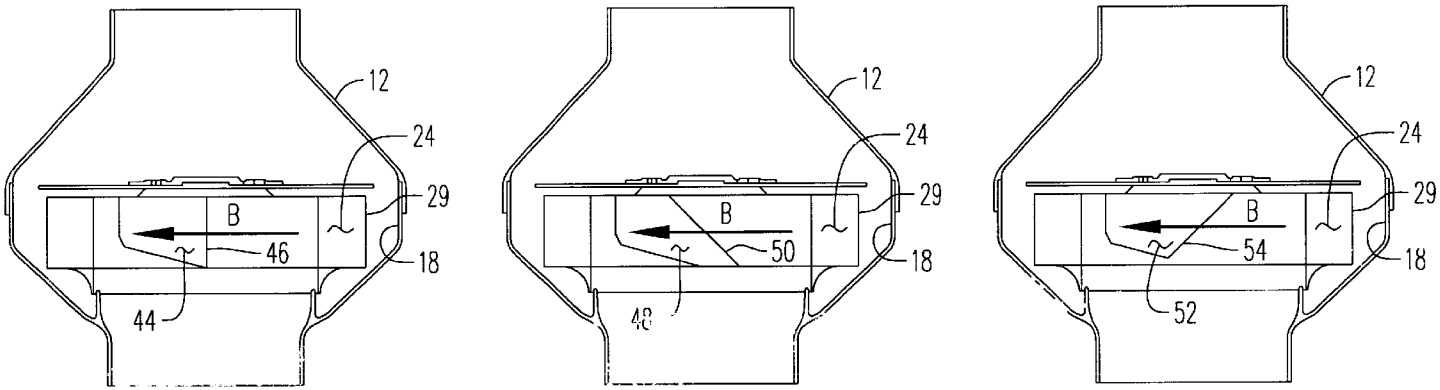
FIG. 6A
FIG. 6B
FIG. 6C
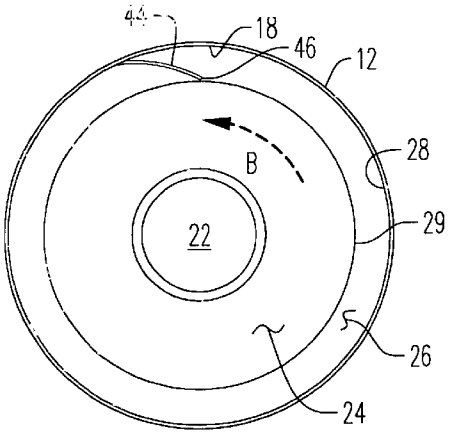
FIG. 7A
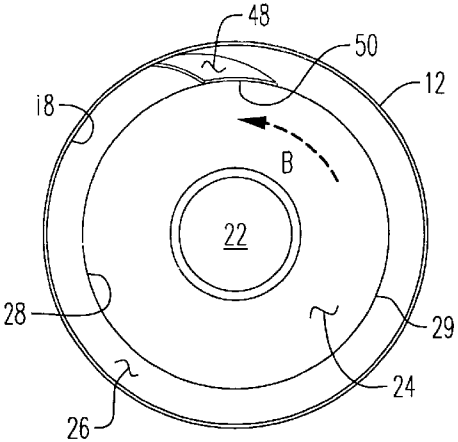
FIG. 7B
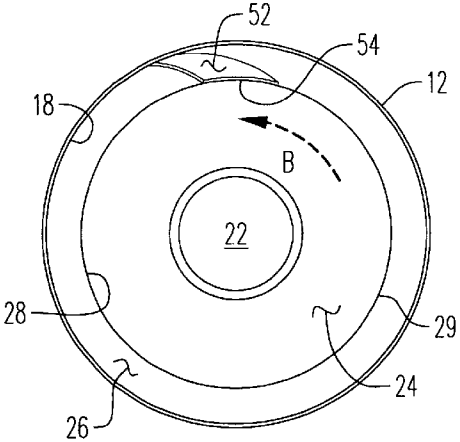
FIG. 7C FIG. 10A
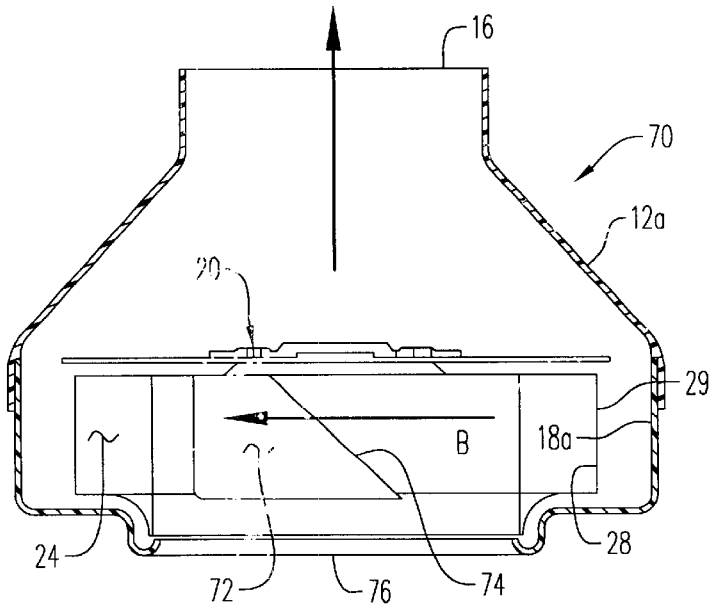
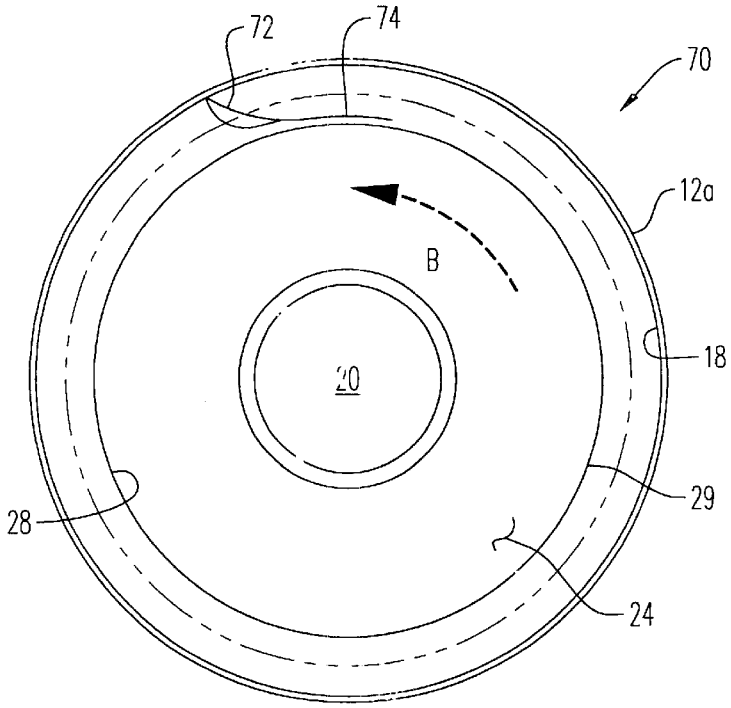
FIG. 10B

IN-LINE CENTRIFUGAL FAN

BACKGROUND OF THE INVENTION

1. Scope of Invention

This invention relates generally to in-line fans, and more particularly to redirecting vanes within the housing of in-line fans of the centrifugal impeller type for enhanced air flow and efficiency.

2. Prior Art

Conventional in-line or duct-type centrifugal impeller-type air flow fans are well known in the art. These fans include a motorized centrifugal impeller assembly positioned centrally within the fan housing between inlet and the outlet thereof. Typically, the housing is enlarged in the central portion thereof to accommodate the desired size and performance of the centrifugal impeller and reduced in diameter at the inlet and the outlet thereof for conduit or duct connection.

Because of the competitive nature of the market for such in-line fans, designers and manufacturers are continually looking for improved efficiency and/or increased air flow produced by these fans. Great effort and sophistication in design have been expended in empirically and theoretically designing the cross section and orientation of these centrifugal impeller blades. However, applicant is unaware of any effort directed to housing additions which achieve the objectives of improved efficiency and air flow by additions to the interior of the housing radially outwardly adjacent to the centrifugal impeller itself.

The present invention is directed to improvements in centrifugal impeller-type in-line fans with the addition of selected numbers and shapes of vanes positioned radially outward from the impeller and which are intended to reduce the swirl or rotation produced by the impeller before the air flow is discharged from the outlet of the housing.

BRIEF SUMMARY OF THE INVENTION

This invention is directed to an in-line fan including a housing having an inlet and an outlet spaced apart and substantially coaxial one to another and a motorized centrifugal-type impeller mounted centrally within the housing substantially coaxially between the inlet and the outlet. A plurality of spaced air flow redirecting vanes are each connected to and radially extend inwardly from an inner surface of said housing toward, but not to, a radially outermost perimeter of the impeller whereby air flow through said housing is increased by the vanes. Various vane configurations, clearances and number of vanes are disclosed.

It is therefore an object of this invention to provide increases in efficiency and air flow of conventional centrifugal impeller-type in-line fans.

It is another object of this invention to enhance air flow through centrifugal impeller-type axial fans by the addition of selected numbers and configurations of fixed air flow redirecting vanes extending within the housing between the housing inner surface and the outer periphery of the centrifugal impeller.

It is another object of this invention to reduce noise emanating from centrifugal impeller-type axial fans by the addition of selected numbers and configurations of fixed air flow redirecting vanes extending within the housing between the housing inner surface and the outer periphery of the centrifugal impeller.

In accordance with these and other objects which will become apparent hereinafter, the instant invention will now be described with reference to the accompanying drawings.

BRIEF DESCRIPTION OF THE DRAWINGS

FIGS. 6A, 6B, 6C/7A, 7B, 7C are simplified side elevation section views and cross sectional views thereof, respectively, of an in-line fan showing the air flow redirecting vanes having variously angled distal or leading edges with respect to the longitudinal axis of the fan.

FIGS. 10A and 10B are a simplified side elevation schematic section view and a cross section view thereof, respectively, of the in-line fan depicting one preferred embodiment of the air flow redirecting vanes.

DETAILED DESCRIPTION OF THE INVENTION

The inventive concept of the invention is focused on the interior volume of space of a conventional centrifugal impeller-type in-line fan which radiates outwardly from the periphery and air discharge of a centrifugal or mixed flow impeller. The invention comprises one or more air flow redirecting vanes positioned within this annular shaped volume within the housing which substantially modify and redirect rotational or spiral air flow emanating from the periphery of the centrifugal impeller into a more axial air flow thereby increasing both performance and efficiency of this improved in-line fan.

In addition to these air flow redirecting vanes functioning as diffusers, their primary operational benefit is derived from the redirecting of the rotational air flow as it flows radially outwardly from the centrifugal impeller within the housing. Previous testing of diffuser vanes which act only as diffusers and not as air flow redirecting vanes produce only about one-third of the benefits of the present invention.

Figure 1:
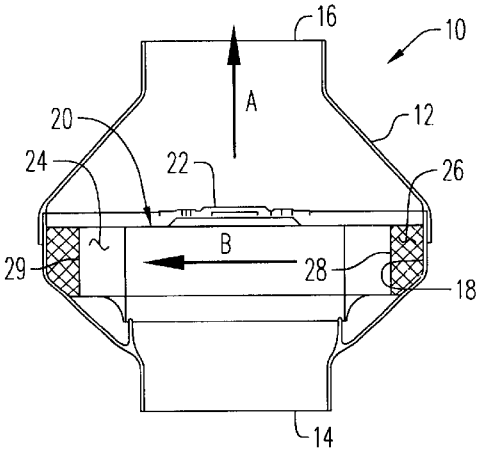
FIG. 1 is a simplified schematic side elevation section cross sectional view of a typical centrifugal impeller-type axial air flow fan showing an annular space in cross hatching into which the invention is positioned.
Figure 2:
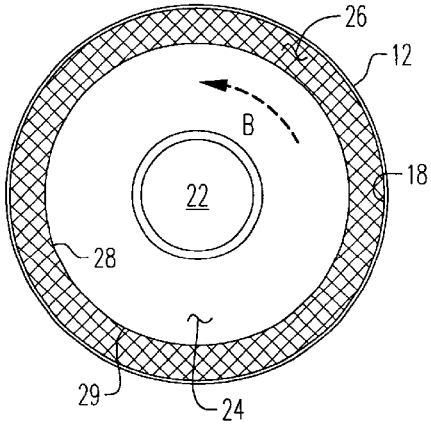
FIG. 2 is a cross section view of FIG. 1 in the region of the air flow redirecting vanes shown by cross hatching.

Turning now to the drawings, and particularly to FIGS. 1 and 2, an improved in-line fan shown there schematically at numeral 10, includes a two-part molded plastic housing 12 defining a inlet 14 and an outlet 16. Air flow through the axial fan 10, and in all subsequent views, is in the direction of arrow A in FIG. 1 and out of the page in FIG. 2 as a motorized centrifugal impeller assembly 20 causes a centrifugal impeller 24 to be rotated in the direction of arrow B by an electrical motor 22. The interior annular-shaped volume 26 of the housing 12 extends from the radially outermost periphery 29 of the impeller 24 to the interior surface 18 of housing 12.

Figure 3A:
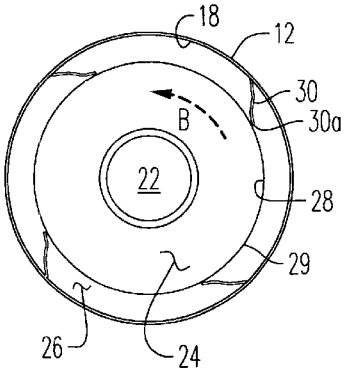
FIGS. 3A, 3B and 3C are simplified schematic cross section views showing the addition of one embodiment of the air flow redirecting vanes in various spaced apart quantities thereof.
Figure 3B:
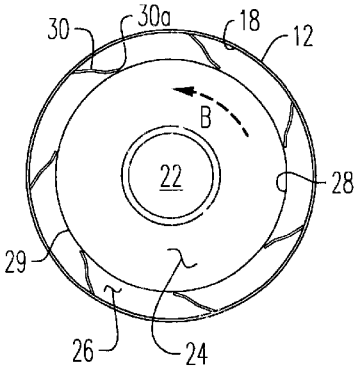
Figure 3C:
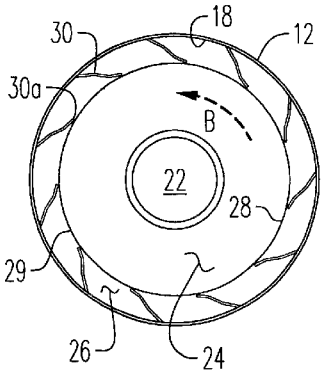

Turning to FIGS. 3A, 3B, and 3C, three embodiments of the invention are there shown with increasing numbers of similarly shaped air flow redirecting vanes 30. Depending upon the size of the impeller 24 and housing 12, the optimal number of vanes 30 may be up to fifteen (15), and perhaps more. If this number of vanes is insufficient, flow separation occurs causing unwanted turbulence within the housing 12. These vanes 30 are oriented so that the distal or leading edge 30*a* of each vane faces into or toward the air flow rotating from the impeller 24 also in the direction of arrow B. In all of these embodiments of FIGS. 3A, 3B and 3C, the configuration of each air flow redirecting vane 30 is that of an elongated S-shape or more generally that of an arcuate recurve configuration, the facing distal edges 30*a* of which approach being tangent to the outer periphery 29 as seen in the Figures. Note that, although in very close proximity one to another, distal edges 30*a* do not contact periphery 29 of the impeller 24.

Figure 4A:
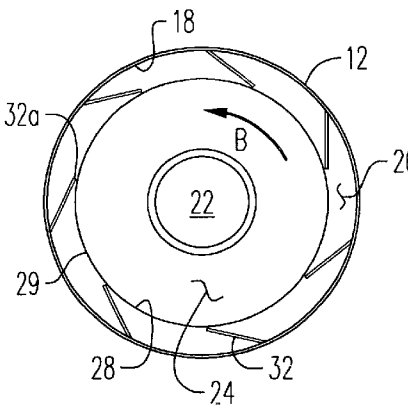
FIGS. 4A, 4B, 4C and 4D are simplified schematic sectional views of the centrifugal-type axial air flow fan and showing the addition of various additional configurations of air flow redirecting vanes.
Figure 4B:
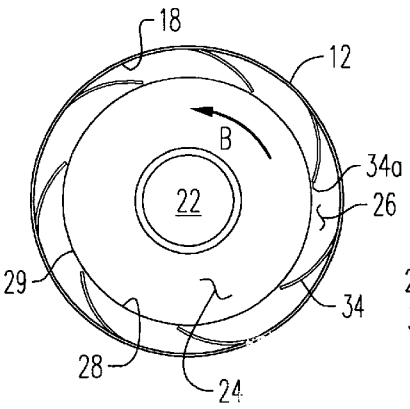
Figure 4C:
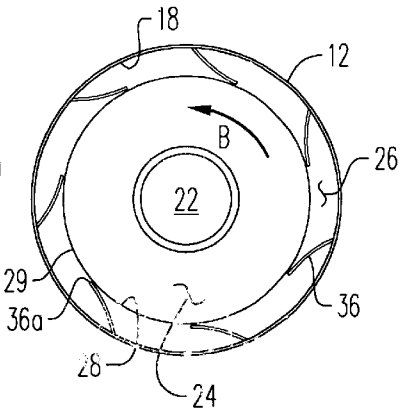
Figure 4D:
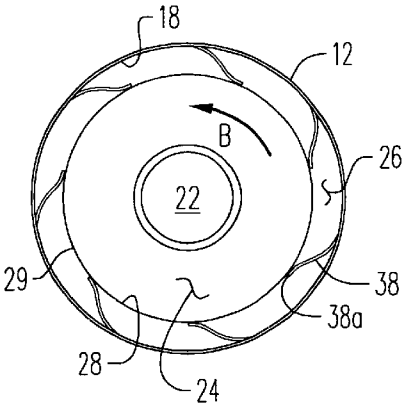

Referring now to FIGS. 4A, 4B, 4C and 4D, several configurations of the end view shape of the impeller vanes within each embodiment are shown generally at numerals 32, 34, 36 and 38, respectively. Vane 32 in FIG. 4A, attached to or molded with the inner surface of molded housing 12 within volume 26, is generally planer or flat and oriented at an acute angle with respect to, but not quite tangent to, the periphery 29 of the impeller 24. Vane 34 is convex in nature with respect to the direction of air flow in the direction of arrow B also having a leading distal edge 34*a* which faces into the direction of air flow and rotation of the impeller 24 and forming a larger acute angle of incidence with respect to the periphery 29. Air flow redirecting vanes 36 in FIGS. 4C are concaved in overall shape being almost tangent to the periphery 29 at their distal edges 36*a* as shown with respect to air flow and rotation in the direction of arrow B. A slightly modified S- or arcuate recurved air flow redirecting vane 38 is shown in FIG. 4D, distal edges 38*a* also being nearly tangent to periphery 29. Each of these vane configurations will produce substantially increased air flow and overall performance through the housing 12 as above described without making contact with the periphery 29. However, the optimum shape thus far has been essentially of the concave design with a slight convex turn at the leading edge, making it almost resemble a reverse of the original S design. The concave portion of the vane serves to turn the airflow, while the convex portion allows the angled leading edge to remain at the same relation to the impeller as it bends around.

Figure 5A:
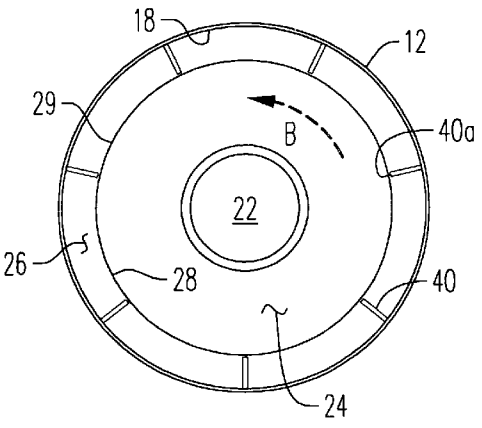
FIGS. 5A and 5B are simplified cross sectional schematic views of the centrifugal impeller-type in-line fan showing the addition of straight or flat air flow redirecting vanes oriented at different acute angles with respect to the rotational direction of air flow within the housing of the fan.
Figure 5B:
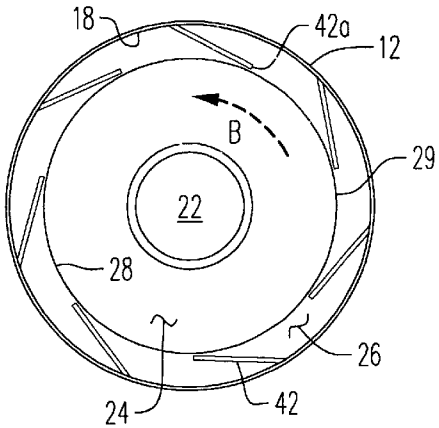

Referring now to FIGS. 5A and 5B, two additional air flow redirecting vane concepts are there shown at 40 and 42. Again, these vanes 40 and 42 are connected to the inner surface of the housing 12 in the volume which extends between the periphery 29 of the impeller 24 and the inner surface 18 of the housing 12. In FIG. 5A, the vanes 40 are oriented substantially orthogonally to the impeller 24 and its direction of rotation B. In FIG. 5A, vanes 42, however, are oriented at an acute angle with respect to the axis of the housing 12 and are generally tangent to the outer periphery of the impeller 24 and its corresponding rotationally induced air flow flowing therefrom.

Referring now to FIGS. 6A, 6B, and 6C and 7A, 7B and 7C, various angular orientations of the leading distal edges 46, 50 and 54 of vanes 44, 48 and 52, respectively, are there shown to demonstrate this aspect of the present invention. In FIGS. 6A and 7A, the distal edge 46 is oriented longitudinally to the axis of the housing 12. Although improving efficiency, this embodiment produces extremely high noise levels which are objectionable.

By angling the leading edge either positively or negatively as shown in FIGS. 6B/7B and 6C/7C, respectively, at approximately 45° with respect to the longitudinal axis, substantial decreases in noise levels were achieved. Although the negatively angled distal edge 54 of vane 52 in FIGS. 6C and 7C was substantially quieter, the vane 48 embodiment of FIGS. 6B and 7B produced greater efficiency and performance.

Figure 8A:
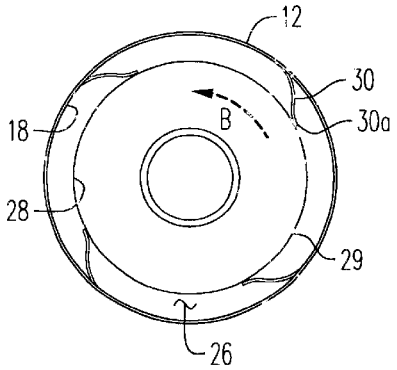
FIGS. 8A and 8B depict symmetric or uniform and non-symmetric spacing between air flow redirecting vanes within the housing of a centrifugal impeller-type axial air flow fan.
Figure 8B:
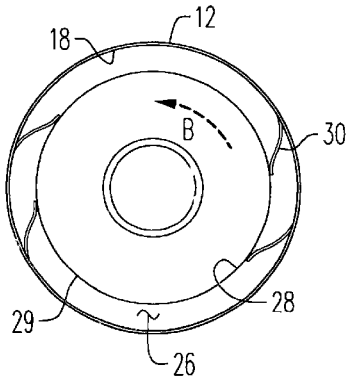

In all of the above-described embodiments, the air flow redirecting vanes were evenly or uniformly spaced apart as shown in FIG. 8A. The vanes 30 are as previously described having a generally gradual S end configuration as shown and having a leading distal edge facing at an acute angle with respect to the periphery 29 of the impeller 24. However, in FIG. 8B, the vanes 30, although symmetric about a vertical or upright plane as shown, are non-symmetrical in nature to demonstrate this aspect of the present invention. Such non-uniform spacing may be useful in accommodating motor mounting brackets and electrical box protrusions (not shown).

Figure 9A:
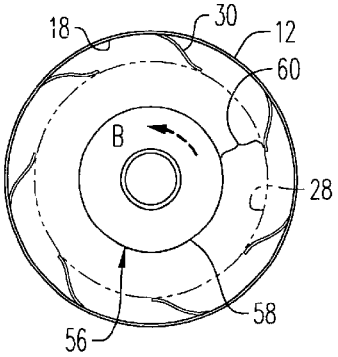
FIGS. 9A, 9B and 9C are simplified cross sectional schematic views depicting a range of lengths of air flow redirecting vanes and varying sized annular volumes around the impeller within which they operate.
Figure 9B:
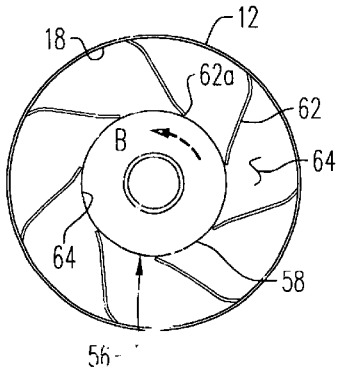
Figure 9C:
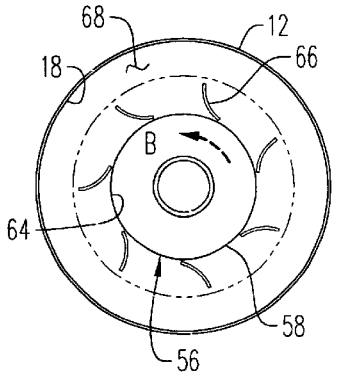

Turning now to FIGS. 9A, 9B, and 9C, alternate embodiments directed to the overall proportionate or relative size of the volume 60, 64 and 68 within housing 12 into which the redirecting vanes 30, 62 and 66, respectively, fit is shown to be variable. In FIG. 9A, air flow redirecting vanes 30, defining the overall radial periphery 28, are also effective in improving efficiency of even a smaller diameter centrifugal impeller 58 of a motorized impeller assembly 56. Thus, in this embodiment, a substantial air gap 60 is defined, rather than, as previously described wherein the inner distal edges of the vane 30 are in close proximity to the outer periphery 29 of impeller 24.

In FIG. 9B, the air flow redirecting vanes 62, also of an elongated S or arcuate recurve configuration, are substantially elongated with respect to the housing 12 and the smaller sized centrifugal impeller 58. However, as in previous embodiments, the radially innermost facing distal edge 62*a* of each of the vanes 62 is positioned in close proximity to the outer periphery of the impeller 58 within annular volume 64.

In FIG. 9C, yet another aspect of the invention shown with respect to concave-shaped air flow redirecting vanes 66 is there shown. In this embodiment of FIG. 9*c*, the vanes 66 are oriented within annular volume 68 offset from the maximum inner surface 18 of housing 12. These vanes 66 are shorter in overall length for weight and material savings.

However, by being positioned in close proximity at 64 to the periphery 58 of the impeller 58, heighten efficiency and increased performance are thereby realized. Note that these vanes 66 may be supported independently by other features within the housing 12 with minimal impact upon performance gains.

One embodiment 70 shown in FIGS. 10A and 10B, designated K200, has been tested extensively and provides considerable improvements. This embodiment 70 includes another configuration of a stamped sheet metal housing 12*d* having a compact inlet area 76, along with the previously described motorized centrifugal impeller assembly 20. Ten (10) of these improved vanes 72 are connected to, and extend radially inward from, the inner surface 18*a* of housing 12*a* also as previously described. The leading or facing distal edge 74 of each of the impeller blades 72, shown in end view in FIG. 10B, has a gradual arcuate configuration blending away from the periphery 29 of the impeller 24 as it extends radially outwardly to the inner surface 18*d* of housing 12. A positive 45° angle in side elevation in FIG. 10A facing outlet 16 is provided.

Figure 10:
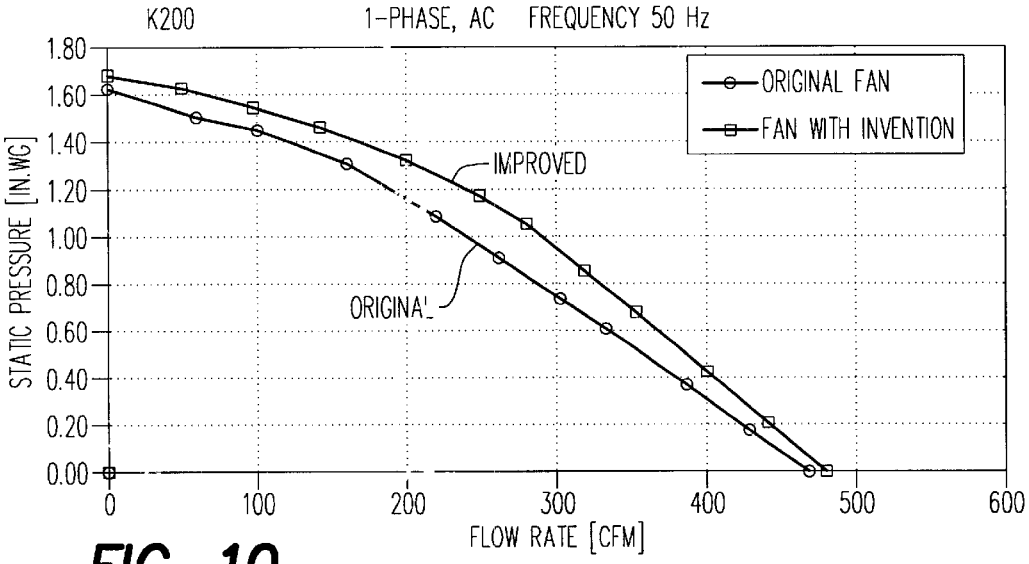
FIGS. 10 through 13 depict performance curves associated with the embodiment of the invention shown in FIGS. 10A and 10B in comparison to an identical axial air flow fan absent the addition of the air flow redirecting vanes.
Figure 11:
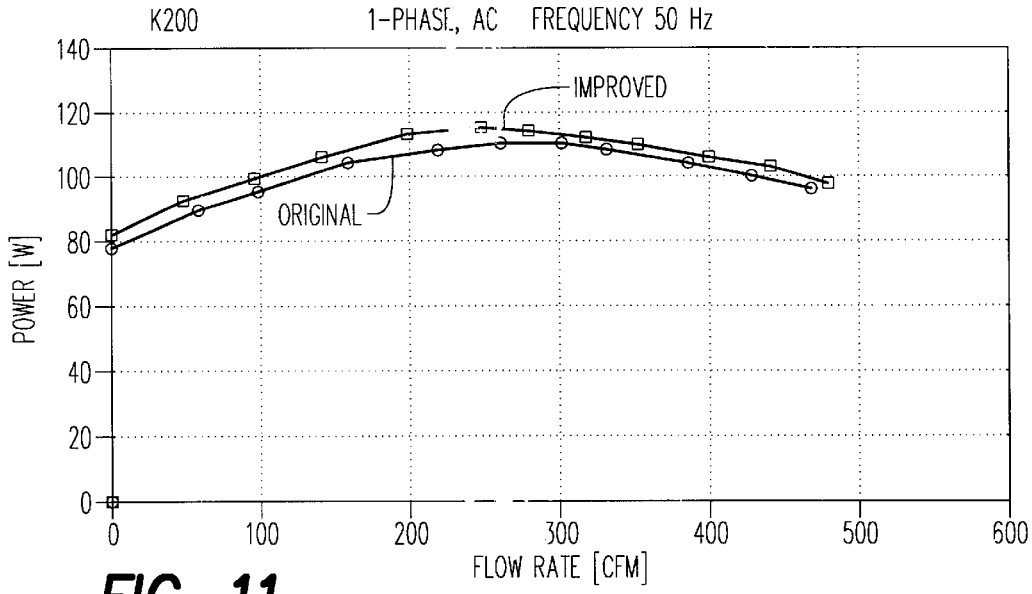
Figure 12:
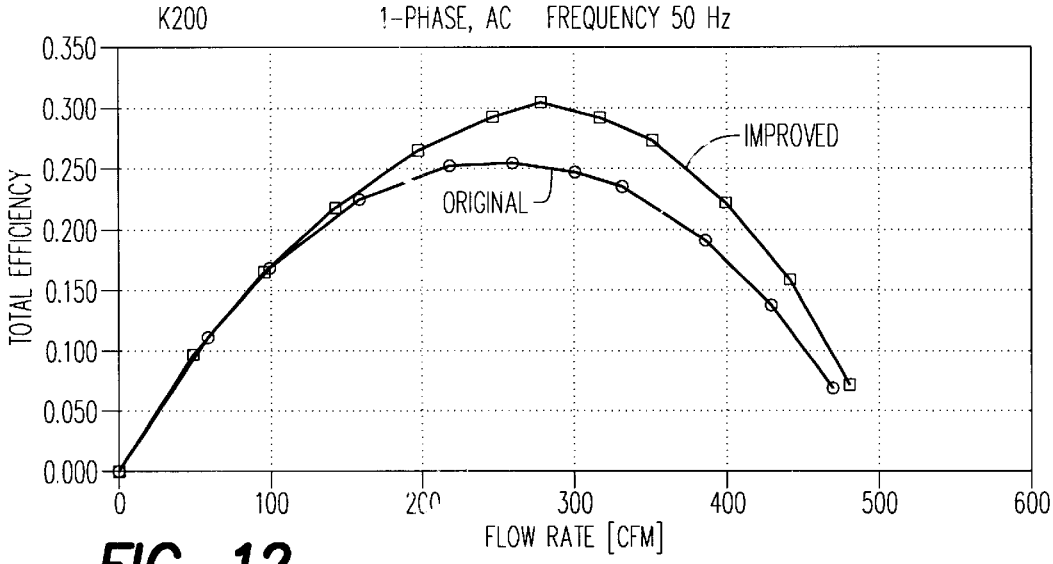
Figure 13:
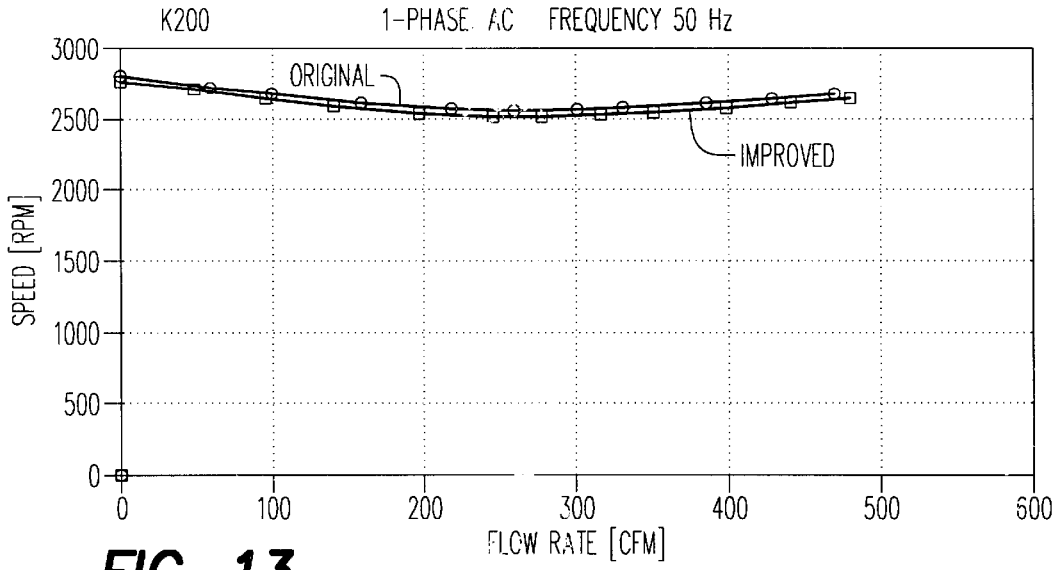

The performance of this experimental fan, designated K200 is shown in FIGS. 10 to 13. In each FIGS. 10 to 13, the performance of the identical in-line fan with and without the vanes 72 are there shown for comparison. In FIG. 10, a substantial increase in air flow at any given static pressure is achieved. In FIG. 11, a significant power decrease to achieve the same air flow through the improved in-line fan 70 is likewise achieved. In comparing overall or total efficiency in FIG. 12 by the ratio of air flow energy produced to electrical power input, at each given flow rate, substantial improvement is achieved increasing from a maximum of 0.260 to 0.310 or a 19% efficiency increase. In FIG. 13, more modest but significant decreases in fan speed are achieved for a given flow rate in CFM by the improvement.

Figure 14A:
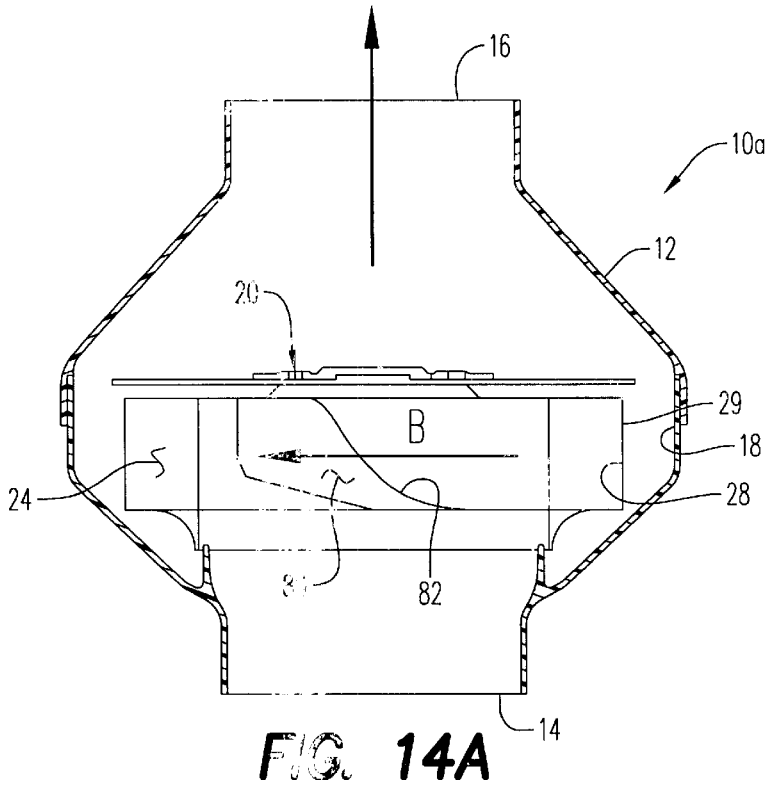
FIGS. 14A and 14B are a simplified side elevation schematic section view and a cross section view thereof, respectively, of the in-line fan depicting another preferred embodiment of the air flow redirecting vanes.
Figure 14B:
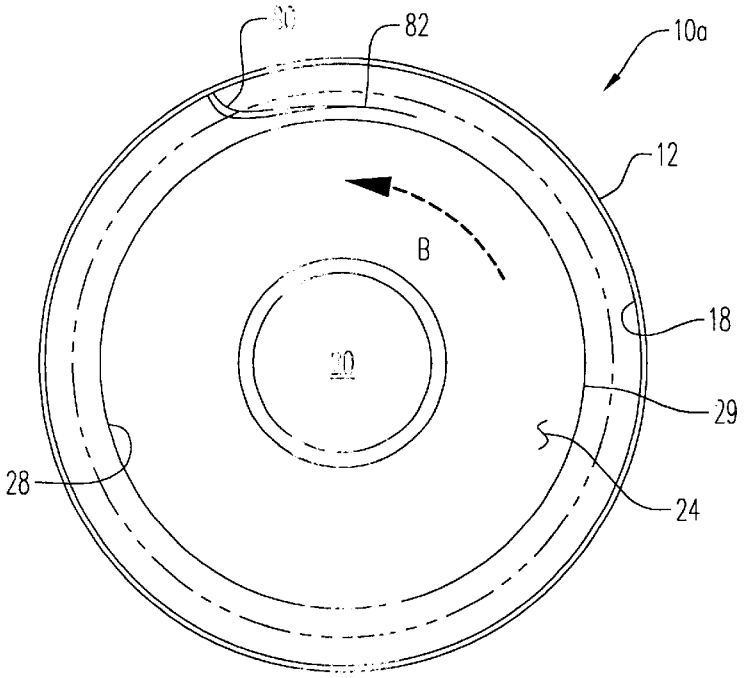

Another experimental design shown in FIGS. 14A and 14B has also been tested. In this embodiment 10*a* and designated as HP2190, the molded plastic housing 12 as previously described includes the motorized centrifugal impeller. assembly 20 and a total of fifteen (15) evenly spaced air flow redirecting vanes 80 which are connected to, and radially extend inwardly from the inner surface 18 of housing 12. Facing distal edge 82 in FIG. 14A is positively oriented facing outlet 16. The side elevation shape of the leading edge 82 is arcuately recurved and produces substantial improvement and decrease in noise. The end view of each of the blades 80 as shown in FIG. 14B extends in close proximity along the periphery 29 over a substantial length of the vane 80, curving tightly toward a nearly orthogonal orientation to the inner surface 18 of the housing 12.

Figure 14:
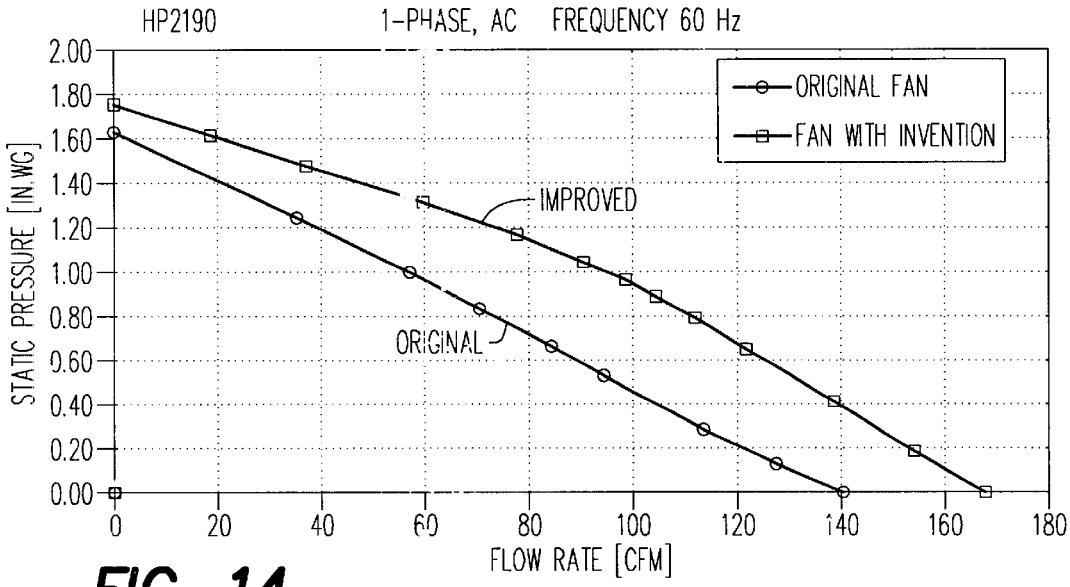
FIGS. 14 to 17 depict performance curves associated with the embodiment of the air flow redirecting vanes shown in FIGS. 14A and 14B in comparison to an identical axial air flow fan absent the addition of the air flow redirecting vanes.
Figure 15:
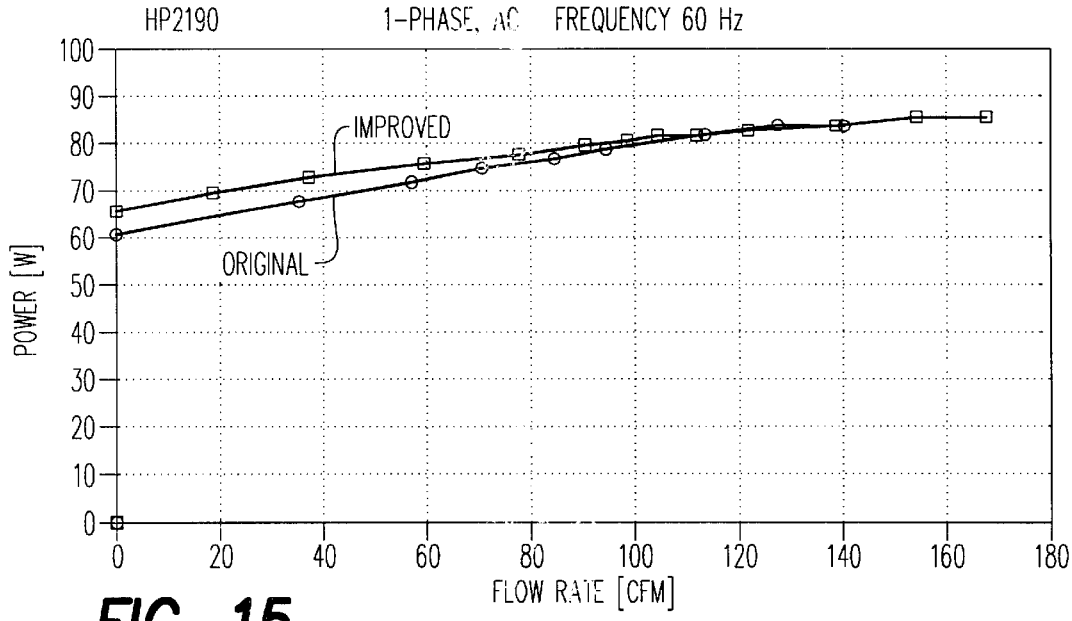
Figure 16:
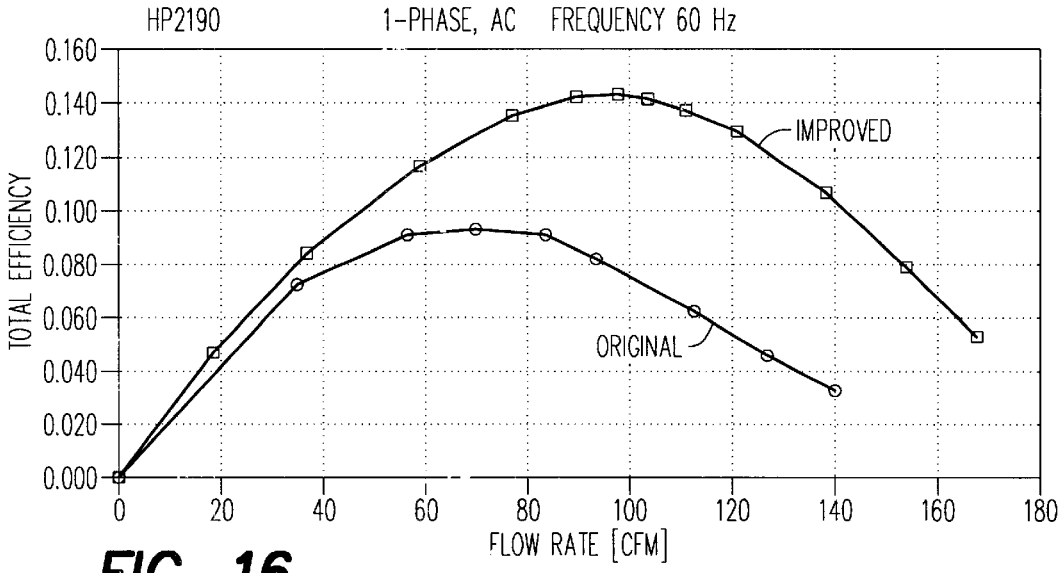
Figure 17:
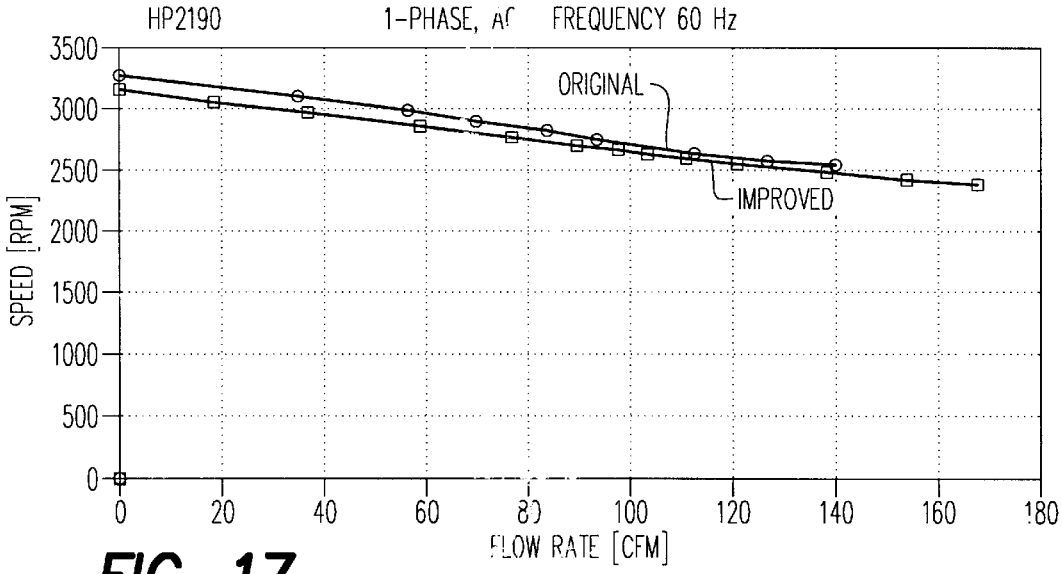

The performance of the HP2190 experimental model 10*a* is shown in FIGS. 14 to 17. As seen in FIG. 14, a substantial increase in air flow at any given static pressure has been realized with the improvement which includes the experimental air flow redirecting vanes 80 of FIGS. 14A and 14B. In FIG. 15, significant reductions in power input in watts are shown to be derived from this improvement 10*a*. Total efficiency of the standard or original design without any air flow redirecting vanes is compared to that of the identical in-line fan with the improved vanes 80 in FIG. 16. Obviously, the HP2190 experimental model 10*a* has afforded substantially greater total efficiency than did the original unmodified sample. Lastly in FIG. 17, significant reductions in impeller speed to achieve the same air flow as compared to an unmodified fan are shown in FIG. 17.

Figure 18:
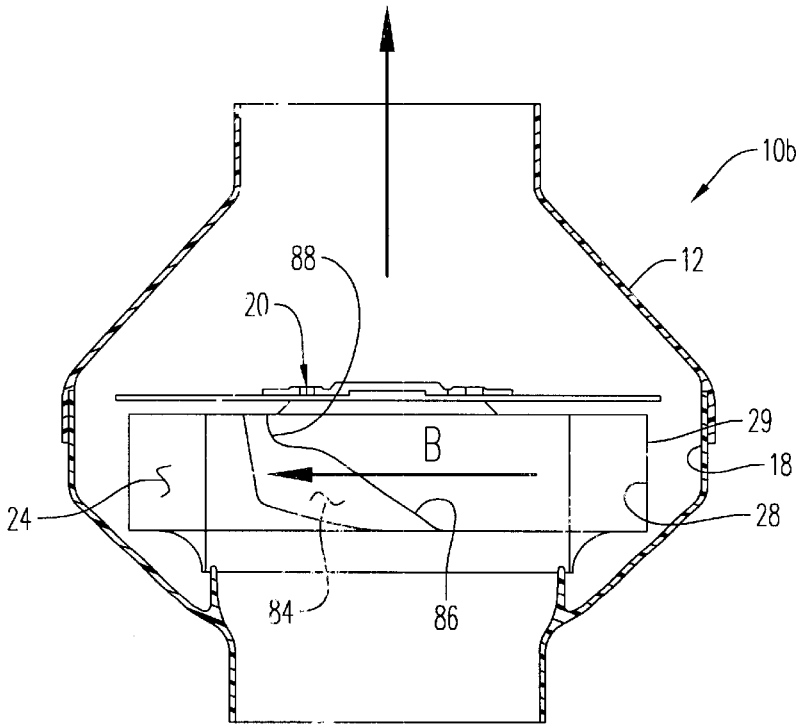
FIGS. 18 and 19 are a simplified side elevation schematic section view and a cross section view thereof, respectively, of the in-line-type fan depicting yet another preferred embodiment of the vanes within an axial air flow fan.
Figure 19:
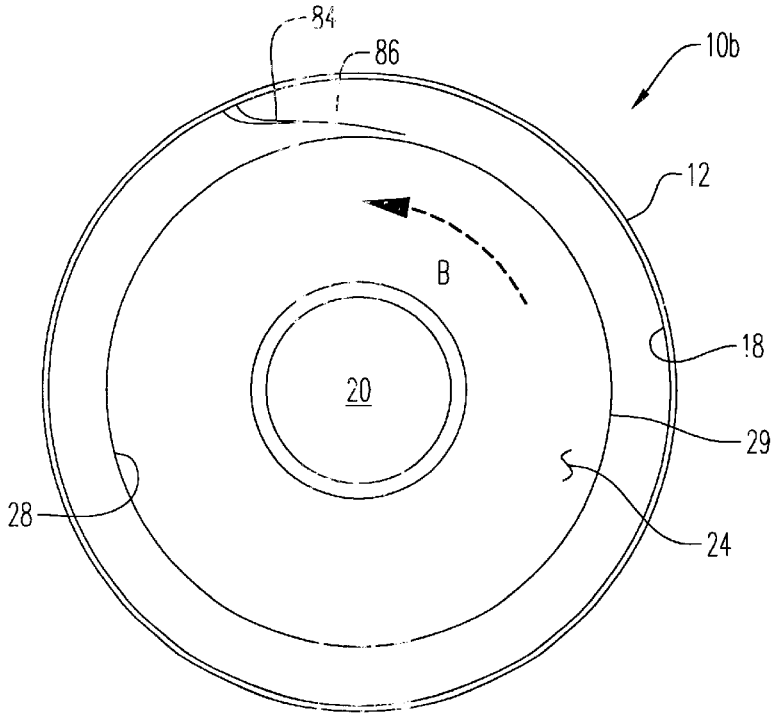

Referring now to FIGS. 18 and 19, a further modification to the embodiment 10*a* of FIGS. 14A and 14B is there shown generally at numeral 10*b* and represents the preferred ultimate embodiment of the invention. In this embodiment 10*b*, each of the evenly spaced air flow redirecting vanes totaling fifteen (15) include a positively oriented distal edge 86 having a straight portion closer to the periphery 29 of the impeller 26 and a notched portion 88 along the portion of the distal edge 86 closer to the inner surface 18 of housing 12. This notch 88 is shown to provide significant further reductions in overall noise produced by the in-line fan 10*b* without sacrificing air flow performance and efficiency as previously described. Note that the proximal edge 90 of each vane 84 is also positively oriented with respect to the outlet of the housing 12 which reduces noise still further.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An in-line centrifugal fan comprising:

a housing having an inlet and an outlet spaced apart and substantially coaxial one to another;

a motorized centrifugal-type impeller mounted centrally within said housing substantially coaxially between said inlet and said outlet;

a plurality of spaced air flow redirecting vanes each having an inner distal edge and connected at an outer proximal edge thereof to, and radially extending inwardly from, an inner surface of said housing toward, but not to, a radially outermost perimeter of said impeller to define a uniform clearance gap between said perimeter and said distal edges, said gap being sized in radial dimension to be no greater than a minimal amount sufficient to avoid contact between said distal edges and said perimeter;

a distal portion of each said vane having an arcuately concaved shape when viewed from said outlet along a longitudinal axis of said housing;

only a distal edge of each said vane positively oriented facing toward said outlet at an acute angle with respect to a longitudinal axis of said housing;

each said vane distal portion is oriented facing into airflow emanating radially outwardly from, and substantially tangent to, said periphery.

2. An in-line centrifugal fan comprising:

a housing having an inlet and an outlet spaced apart and substantially coaxial one to another;

a motorized centrifugal-type impeller mounted centrally within said housing substantially coaxially between said inlet and said outlet;

a plurality of spaced air flow redirecting vanes each having an inner distal edge and connected at an outer proximal edge thereof to, and radially extending inwardly from, an inner surface of said housing toward, but not to, a radially outermost perimeter of said impeller to define a uniform clearance gap between said perimeter and said distal edges, said gap being sized in radial dimension to be no greater than a minimal amount sufficient to avoid contact between said distal edges and said perimeter;

a distal portion of each said vane having an arcuately concaved shape when viewed from said outlet along a longitudinal axis of said housing;

a distal edge of each said vane positively oriented facing toward said outlet at an acute angle with respect to a longitudinal axis of said housing;

each said vane distal portion is oriented facing into air flow emanating radially outwardly from, and substantially tangent to, said periphery;

each said vane has an elongated S-shape or recurve configuration when viewed from said outlet.

3. An in-line centrifugal fan comprising:

a housing having an inlet and an outlet spaced apart and substantially coaxial one to another;

a motorized centrifugal-type impeller mounted centrally within said housing substantially coaxially between said inlet and said outlet;

a plurality of spaced air flow redirecting vanes each having an inner distal edge and connected at an outer proximal edge thereof to, and radially extending inwardly from, an inner surface of said housing toward, but not to, a radially outermost perimeter of said impeller to define a uniform clearance gap between said perimeter and said distal edges, said gap being sized in radial dimension to be no greater than a minimal amount sufficient to avoid contact between said distal edges and said perimeter;

a distal portion of each said vane having an arcuately concaved shape when viewed from said outlet along a longitudinal axis of said housing;

a distal edge of each said vane positively oriented facing toward said outlet at an acute angle with respect to a longitudinal axis of said housing;

each said vane distal portion is oriented facing into air flow emanating radially outwardly from, and substantially tangent to, said periphery;

each said proximal edge is positively oriented toward said outlet at an acute angle with respect to the longitudinal axis.

* * * * *